US007255633B2

(12) United States Patent
Muldowney

(10) Patent No.: US 7,255,633 B2
(45) Date of Patent: Aug. 14, 2007

(54) RADIAL-BIASED POLISHING PAD

(75) Inventor: Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/392,373

(22) Filed: Mar. 29, 2006

(65) Prior Publication Data

US 2006/0229002 A1 Oct. 12, 2006

Related U.S. Application Data

(60) Provisional application No. 60/670,466, filed on Apr. 12, 2005.

(51) Int. Cl.
*B24B 7/22* (2006.01)
*B24D 13/14* (2006.01)

(52) U.S. Cl. ..... 451/56; 451/527; 451/41

(58) Field of Classification Search ..... 451/56, 451/527, 443, 444, 533, 41
See application file for complete search history.

(56) References Cited

U.S. PATENT DOCUMENTS

| | | | |
|---|---|---|---|
| 5,081,051 A | 1/1992 | Mattingly et al. | |
| 5,216,843 A | 6/1993 | Breivogel et al. | |
| 5,611,943 A | 3/1997 | Cadien et al. | |
| 5,645,469 A | 7/1997 | Burke et al. | |
| 5,785,585 A | 7/1998 | Manfredi et al. | |
| 5,885,147 A | 3/1999 | Kreager et al. | |
| 5,916,010 A | 6/1999 | Varian et al. | |
| 5,938,507 A | 8/1999 | Ko et al. | |
| 6,402,883 B1 | 6/2002 | Billett | |
| 6,626,743 B1 | 9/2003 | Boyd | |
| 6,767,427 B2 | 7/2004 | Walters et al. | |
| 6,843,711 B1 * | 1/2005 | Muldowney | 451/527 |
| 2001/0006871 A1 | 7/2001 | Moore | |
| 2004/0166785 A1 | 8/2004 | Golzarian et al. | |

FOREIGN PATENT DOCUMENTS

WO WO 01/91969 A2 12/2001

OTHER PUBLICATIONS

Tseng et al.; "Comparison of Various Pad Conditioning Approaches—Simulation, Parameters Evaluation, and Discussion", 1998 VMIC Conference, Jun. 16-18, pp. 518-520.

* cited by examiner

*Primary Examiner*—Robert A. Rose
(74) *Attorney, Agent, or Firm*—Blake T. Biederman

(57) ABSTRACT

The polishing pad is useful for polishing magnetic, optical and semiconductor substrates. The pad includes a polishing layer having a rotational center and an annular polishing track concentric with the rotational center and has a width. The width of the annular polishing track is free of non-radial grooves. And the pad has a plurality of radial micro-channels in the polishing layer within the width of the annular polishing track with a majority of the radial micro-channels having primarily a radial orientation and an average width less than 50 μm.

7 Claims, 8 Drawing Sheets

RADIAL-BIASED POLISHING PAD

CROSS REFERENCE TO RELATED APPLICATION

This application claims the benefit of U.S. Provisional Application Ser. No. 60/670,466 filed Apr. 12, 2005.

BACKGROUND OF THE INVENTION

The present invention relates generally to the field of polishing pads for chemical mechanical polishing. In particular, the present invention relates to conditioned polishing pads useful for chemical mechanical polishing magnetic, optical and semiconductor substrates.

In the fabrication of integrated circuits and other electronic devices, multiple layers of conducting, semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials. Planarization is measured at the wafer scale in terms of uniformity. Typically, thin film thickness is measured at tens to hundreds of points on the surface of the wafer, and the standard deviation is calculated. Planarization is also measured at the device feature scale. This nanotopography is measured in terms of dishing and erosion, among others. Typically nanotopography is resolved at higher frequency, but measured over a smaller area.

Chemical mechanical planarization, or chemical mechanical polishing (CMP), is a common technique used to planarize or polish workpieces such as semiconductor wafers. In conventional CMP, a wafer carrier, or polishing head, is mounted on a carrier assembly. The polishing head holds the wafer and positions the wafer in contact with a polishing layer of a polishing pad within a CMP apparatus. The carrier assembly provides a controllable pressure between the wafer and polishing pad. Simultaneously, a slurry, or other polishing medium flows onto the polishing pad and into the gap between the wafer and polishing layer. To effect polishing, the polishing pad and wafer typically rotate relative to one another. The wafer surface is polished and made planar by chemical and mechanical action of the polishing layer and polishing medium on the surface. As the polishing pad rotates beneath the wafer, the wafer sweeps out a typically annular polishing track, or polishing region, wherein the wafer's surface directly confronts the polishing layer.

Important considerations in designing a polishing layer include the distribution of polishing medium across the face of the polishing layer, the flow of fresh polishing medium into the polishing track, the flow of used polishing medium from the polishing track and the amount of polishing medium that flows through the polishing zone essentially unutilized, among others. One way to address these considerations is to provide the polishing layer with a grooved macro-texture. Over the years, quite a few different groove patterns and configurations have been implemented. Typical groove patterns include radial, concentric-circular, Cartesian-grid and spiral, among others.

In addition to distribution and flow of polishing medium, groove pattern and configuration affect other important aspects of the CMP process, and ultimately wafer planarity, such as polishing rate, edge effect, dishing and others. Furthermore, groove pattern and configuration affect wafer planarity through a phenomenon known as "groove pattern transfer." The result of this phenomenon is that certain groove patterns result in the creation of coherent structures on the surface of the wafer corresponding to the pattern of the grooves on the polishing pad. Importantly, circumferential grooves (grooves which make small angles with a line tangent to polishing pad velocity), i.e. circular grooves, circular x-y grooves or spiral grooves, produce a more pronounced groove pattern transfer effect than x-y grooves or radial grooves.

Polishing pad conditioning is critical to maintaining a consistent polishing surface for consistent polishing performance. Over time the polishing surface of the polishing pad wears down, smoothing over the micro-texture ("glazing") of the polishing surface. Additionally, debris from the CMP process can clog the micro-channels through which slurry flows across the polishing surface. When this occurs, the polishing rate of the CMP process decreases; and this can result in non-uniform polishing between wafers or within a wafer. Periodic or continuous "in situ" conditioning creates a new texture on the polishing surface useful for maintaining the desired polishing rate and uniformity in the CMP process.

Conventional polishing pad conditioning is achieved by abrading the polishing surface mechanically with a conditioning disk. The conditioning disk has a rough conditioning surface typically comprised of embedded diamond points. The conditioning disk is brought into contact with the polishing surface either during a break in the CMP process, or while the CMP process is underway. Typically the conditioning disk is rotated in a position that is fixed with respect to the axis of rotation of the polishing pad, and sweeps out an annular conditioning region as the polishing pad is rotated. The conditioning process as described creates uniform conditioning in the conditioning region with the micro-channels typically having a circumferentially biased orientation because the linear velocity of the polishing table exceeds that of any point on the conditioning disk.

Non-uniform conditioning has been disclosed in the prior art to increase the flow of polishing medium on the polishing surface. For example, in U.S. Pat. No. 5,216,843, Breivogel et al. disclose a polishing pad having circumferential macro-grooves and radial microgrooves created by a diamond point conditioning process. The polishing pad of Breivogel et al., however, contains circumferential grooves that suffer from the undesirable effects of groove pattern transfer. This groove pattern transfer can produce non-uniform wafers having undesirable coherent structures that amount to under-polished wafer regions. Being typically tens of nanometers or greater in height, the coherent structures resulting from groove pattern transfer will be unacceptable for the future manufacture of semiconductor wafers.

There is a need for a polishing pad that will control distribution and flow of polishing medium in the CMP process and produce uniform wafers with a greater degree of planarity.

STATEMENT OF THE INVENTION

An aspect of the invention includes a polishing pad useful for polishing at least one of a magnetic, optical and semiconductor substrate, comprising: a) a polishing layer having a rotational center and including an annular polishing track concentric with the rotational center and having a width, the width of the annular polishing track being free of non-radial grooves for reducing groove pattern transfer, non-radial grooves being grooves that have an orientation within 30 degrees of circumferential with respect to the rotational center; and b) a plurality of radial micro-channels in the polishing layer within the width of the annular polishing track and a majority of the radial micro-channels having primarily a radial orientation and having an average width less than 50 μm.

Another aspect of the invention includes a polishing pad useful for polishing at least one of a magnetic, optical and semiconductor substrate, comprising: a) a polishing layer having a rotational center and including an annular polishing track concentric with the rotational center and having a width, the width of the annular polishing track containing radial grooves, the radial grooves having an average cross sectional area; and b) a plurality of radial micro-channels in the polishing layer within the width of the annular polishing track, the radial micro-channels having an average cross sectional area at a multiple of at least ten less than the average cross-sectional area of the radial grooves and a majority of the radial micro-channels having primarily a radial orientation.

Another aspect of the invention includes a method of polishing at least one of a magnetic, optical and semiconductor substrate in the presence of a polishing medium, comprising: polishing with a polishing pad, the polishing pad including a polishing layer having a rotational center and including an annular polishing track concentric with the rotational center and having a width, the width of the annular polishing track being free of non-radial grooves for reducing groove pattern transfer, non-radial grooves being grooves that have an orientation within 30 degrees of circumferential with respect to the rotational center; and a plurality of radial micro-channels in the polishing layer within the width of the annular polishing track and a majority of the radial micro-channels having primarily a radial orientation and having an average width less than 50 μm; and conditioning the pad during polishing to introduce additional radial micro-channels.

Another aspect of the invention includes a method of polishing at least one of a magnetic, optical and semiconductor substrate in the presence of a polishing medium, comprising: polishing with a polishing pad, the polishing pad including a polishing layer having a rotational center and including an annular polishing track concentric with the rotational center and having a width, the width of the annular polishing track containing radial grooves, the radial grooves having an average cross-sectional area; and a plurality of radial micro-channels in the polishing layer within the width of the annular polishing track, the radial micro-channels having an average cross-sectional area at a multiple of at least ten less than the average cross-sectional area of the radial grooves and a majority of the radial micro-channels having primarily a radial orientation; and conditioning the pad during polishing to introduce additional radial micro-channels.

DETAILED DESCRIPTION OF THE INVENTION

Figure 1:
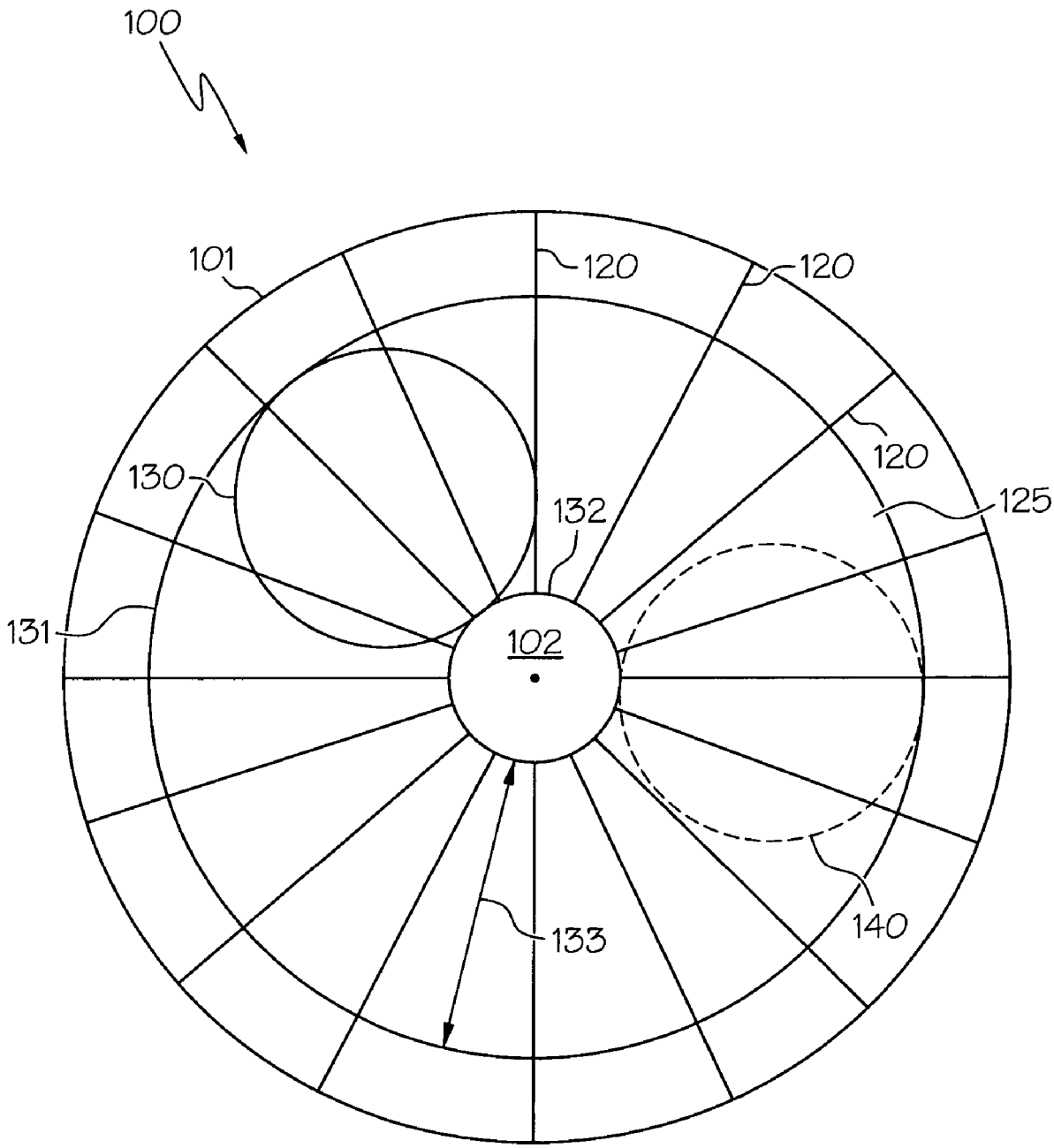
FIG. 1 is a plan view of a polishing pad of the present invention having radial grooves.

The invention relates to polishing pads having a macro- and micro-texture that reduces groove pattern transfer effects on the resulting polished substrate. It has been discovered that radial conditioning can reduce surface non-uniformities on magnetic, optical and semiconductor substrates. For purposes of this specification, radial direction refers to a path within 60 degrees of a straight line from the center to the circumference of the polishing pad ("radial direction"). Preferably, the micro-channels are within 45 degrees and most preferably within 30 degrees of the radial direction. The radial micro-channels produced by conditioning can facilitate outward slurry distribution that can reduce under-polished regions associated with the groove pattern transfer phenomena. Typically, the greater percentage of micro-channels with a radial direction, the less under-polished regions result from the polishing. For purposes of this specification, a majority of radial-biased micro-channels refers to the total of radial micro-channels measured by linear total, being greater than non-radial micro-channels measured by linear total. These radially conditioned pads can facilitate uniformity of the wafer on a scale that corresponds to the frequency of the micro-channels when polishing substrates with a polishing medium. As used in this specification, the term "polishing medium" includes particle-containing polishing solutions and non-particle-containing solutions, such as abrasive-free and reactive-liquid polishing solutions.

Typical polymeric polishing pad materials include polycarbonate, polysulfone, nylon, polyethers, polyesters, polyether-polyester copolymers, acrylic polymers, polymethyl methacrylate, polyvinyl chloride, polyethylene copolymers, polybutadiene, polyethylene imine, polyurethanes, polyether sulfone, polyether imide, polyketones, epoxies, silicones, copolymers thereof and mixtures thereof. Preferably, the polymeric material is a polyurethane; and most preferably it is a cross-linked polyurethane, such as, IC1000™ and VisionPad™ polishing pads manufactured by Rohm and Haas Electronic Materials CMP Technologies. These pads typically constitute polyurethanes derived from difunctional or polyfunctional isocyanates, e.g. polyetherureas, polyisocyanurates, polyurethanes, polyureas, polyurethaneureas, copolymers thereof and mixtures thereof.

These polishing pads can be porous or non-porous. If porous, these polishing pads typically contain a porosity of at least 0.1 volume percent. This porosity contributes to the polishing pad's ability to transfer polishing fluids. Preferably, the polishing pad has a porosity of 0.2 to 70 volume percent. Most preferably, the polishing pad has a porosity of 0.25 to 60 volume percent. Preferably the pores or filler particles have a weight average diameter of 1 to 100 μm. Most preferably, the pores or filler particles have a weight average diameter of 10 to 90 μm. Furthermore, a weight average diameter of 10 to 30 μm (most preferably, 15 to 25 μm) can further improve polishing performance. The nominal range of expanded hollow-polymeric microspheres' weight average diameters is typically 10 to 50 μm. Optionally, it is possible to add unexpanded hollow-polymeric microspheres directly into a liquid prepolymer blend. Typically, unexpanded microspheres expand in situ during casting.

It is possible to introduce the porosity by casting hollow microspheres, either pre-expanded or expanded in situ; by using chemical foaming agents; by use of dissolved gases, such as argon, carbon dioxide, helium, nitrogen, and air, or supercritical fluids, such as supercritical carbon dioxide; by sintering polymer particles; by selective dissolution; mechanical aeration, such as stirring; or by using an adhesive to agglomerate polymer particles.

In addition, polymeric polishing pads may include polymeric film-forming materials of which a liquid solvent solution forms and a layer of the solution dries to form a normally solid polymeric film (i.e., solid at normal atmospheric temperatures). The polymeric material can consist of straight polymers or blends thereof, with additives such as curatives, coloring agents, plasticizers, stabilizers and fillers. Example polymers include, polyurethane polymers, vinyl halide polymers, polyamides, polyesteramides, polyesters, polycarbonates, polyvinyl butyral, polyalphamethylstyrene, polyvinylidene chloride, alkyl esters of acrylic and methacrylic acids, chlorosulfonated polyethylene, copolymers of butadiene and acrylonitrile, cellulose esters and ethers, polystyrene and combinations thereof. Preferably, porous coagulated polishing pads have a porous matrix formed with a polyurethane polymer. Most preferably, the porous polishing pads form from coagulating a polyetherurethane polymer with polyvinyl chloride, such as Politex™ polishing pads from Rohm and Haas Electronic Materials CMP Technologies. It is possible to deposit the coagulated matrix on a felt-type or a film-based matrix, such as a Mylar™ polyethylene terephthalate film. The porous matrix has a non-fibrous polishing layer. For purposes of this specification, polishing layer is that portion of the polishing pad capable of contacting a substrate during polishing. Although a closed cell or non-reticulated structure is acceptable, most advantageously, this structure is an open or reticulated cell structure containing micro-porous openings that connect the cells. The micro-porous reticulated structure allows gas flow through the pores, but limits slurry penetration into the polishing pad to maintain a more uniform polishing pad thickness during polishing.

Typical radial micro-channels can have an average width less than 50 μm, but with aggressive diamond conditioning may have a width as great as 100, 150 or 200 μm. Depending upon diamond shape, cut rate and substrate, the micro-channels typically have a depth of at least equal, double or triple the micro-channel width. Because of the wear conditions associated with polishing and continuous or semi-continuous conditioning, the pad will contain micro-channels having a range of micro-channel heights and widths. A majority of these micro-channels have a radial orientation in the wafer track, but preferably at least 80 percent have a radial orientation in the wafer track. Most preferably, all micro-channels have a radial direction in the wafer track Although typical CMP polishing operations can rely upon oscillation of the wafer during polishing to increase uniformity, for purposes of this specification, the phrase in the polishing track or in the wafer track refers to the wafer track produced without oscillation.

For porous polishing pad substrates, the pad typically has radial micro-channel lengths of at least 100 times the average pore diameter. Preferably, the porous pads have radial micro-channel lengths of at least 10,000 times the average pore diameter. The increased length in the radial direction tends to facilitate slurry flow, debris removal and reduce pattern transfer onto the substrate, such as a semiconductor wafer.

In addition, to avoid the under-polish regions associated with grooves, the polishing pad preferentially does not include circular or spiral grooves in the wafer track. Most preferably, the pad does not have any grooves within 30 degrees of circumferential with respect to the rotational center. This avoids the groove configurations associated with the worst groove pattern transfer issues. To further limit groove pattern transfer, the polishing pad may optionally contain no grooves having an average cross-sectional area (average groove depth multiplied by average groove width for rectangular shaped groove cross-sections) of greater than 15,000 $\mu m^2$ within the annular polishing track. This can optionally be further limited to eliminating grooves of cross-sectional areas greater than 7,500 $\mu m^2$ within the annular polishing track.

The polishing pad optionally contains radial macro-grooves, such as straight-radial, curved-radial, stepped-radial or other radially-biased grooves in addition to the radial micro-channels. Adding radial grooves to the radial micro-channels further increases removal rate and facilitates debris removal. Introducing curved-radial grooves can have the further advantage of improving polishing uniformity across a substrate. These curved-radial designs are particularly effective for large-scale polishing, such as polishing 300 mm semiconductor wafers. When adding radial grooves, the grooves typically have a cross-sectional area of at least 10 times greater than the cross-sectional area of the micro-channels. Preferably, the radial grooves have a cross-sectional area of at least 100 times greater than the cross-sectional area of the micro-channels. For purposes of this specification, this cross-sectional area ratio refers to the initial ratio during polishing and it does not refer to the final ratio obtained at the end of the polishing process where conditioning and pad wear can dramatically decrease groove depth.

Referring now to the drawings, FIG. 1 illustrates a polishing pad 100 having a circumference 101 and a rotational center 102. As the polishing pad 100 is rotated during the CMP process, the wafer 130, held in contact with the polishing layer (not shown), sweeps out an annular polishing track (or wafer track) 125 defined by an outer boundary 131 and an inner boundary 132, having a width 133. Additionally, the polishing pad may have grooves such as straight-radial grooves 120 to increase slurry residence time and facilitate polishing efficiency.

Figure 1A:
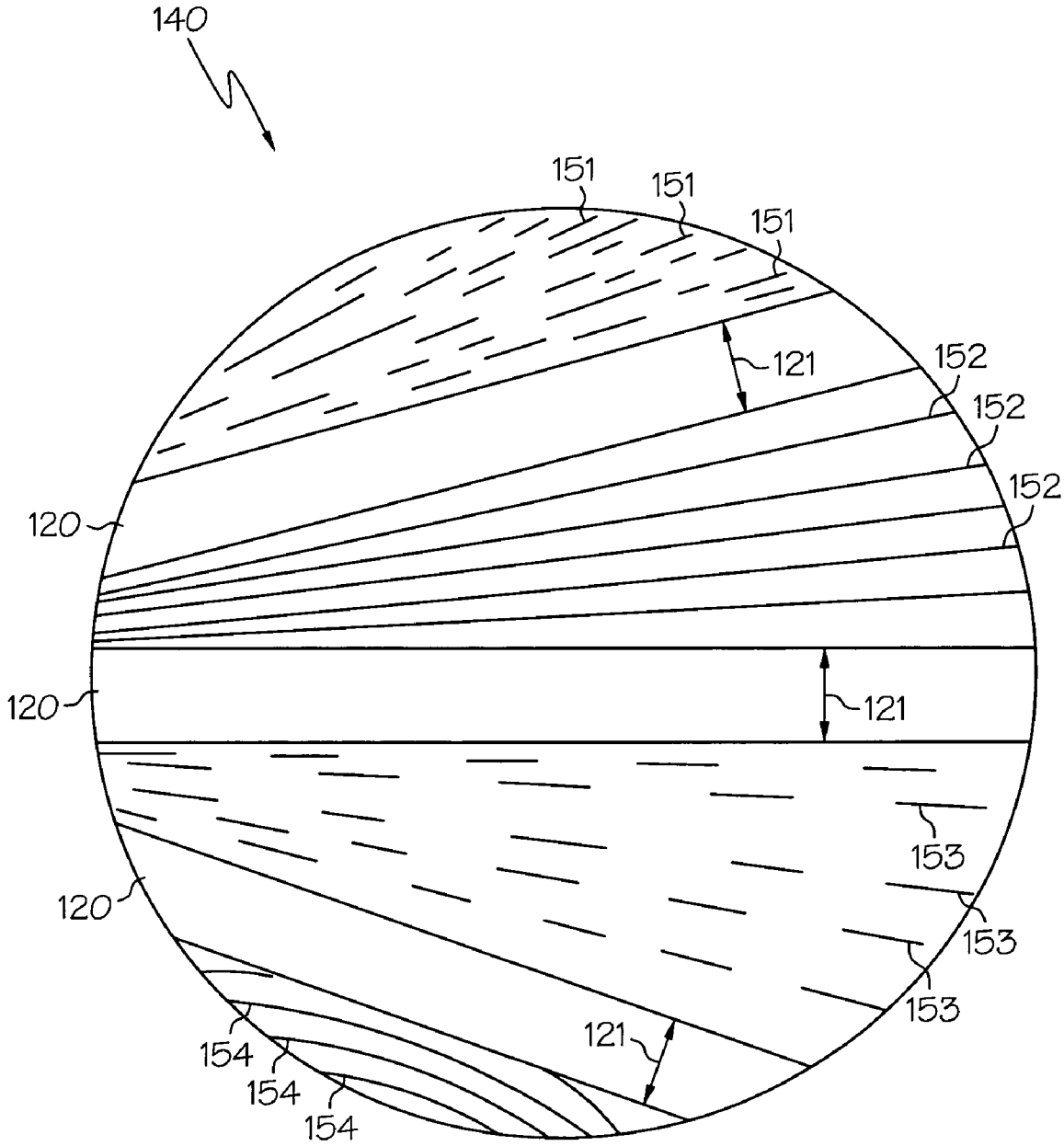
FIG. 1A is an enlarged plan view of the polishing pad of FIG. 1.

FIG. 1A illustrates, in connection with polishing pad 100 of FIG. 1, an enlarged view of the polishing layer in the region 140 of FIG. 1. Straight-radial grooves 120 are shown to have a width 121. The width may vary, but preferably the width 121 is the same for all grooves and uniform along the length of each groove. The straight-radial grooves 120 also have a depth that gradually decreases with conditioning and polishing. In the region between the straight-radial grooves 120 are radial micro-channels 151, 152, 153 and 154. The radial micro-channels 151, 152, 153 and 154 also have a width (not shown). The width and cross-sectional area of the radial micro-channels is less than the width and cross-sectional area of the grooves 121.

The radial micro-channels may have many patterns and configurations. For example, the radial micro-channels may be straight-radial micro-channels 151, 152 and 153, or they may be curved like radial micro-channels 154. The radial micro-channels may be continuous throughout the polishing track like radial micro-channels 152, or they may be segmented radial micro-channels 151 or 153. The radial micro-channel segments may be regularly spaced and uniform length like radial micro-channels 153, or they may be irregularly spaced and irregular length like radial micro-channels 151. Additionally, the radial micro-channels may have uniform density throughout the width of the polishing track or the density may vary in a radial direction, in a circumferential direction, or both. Typically, increasing density of the micro-channels will correspond to a localized increase in removal rate. Optionally, the radial micro-channels 151, 152, 153 and 154 intersect with the grooves 120 to facilitate radial flow of the polishing medium and to improve the removal of polishing debris. In another optional embodiment, the radial mirco-channels 151, 152, 153 and 154 do not intersect with the grooves 120.

Radial micro-channels 151, 152, 153 and 154 are shown in the same figure for convenience. While a polishing pad of the present invention such as polishing pad 100 may have different micro-channel patterns and configurations in different regions between grooves (or different regions in a polishing pad without grooves), it is preferable that a polishing pad have only one micro-channel pattern and configuration or have multiple micro-channel configurations placed into the polishing surface in a symmetrical manner.

Figure 2:
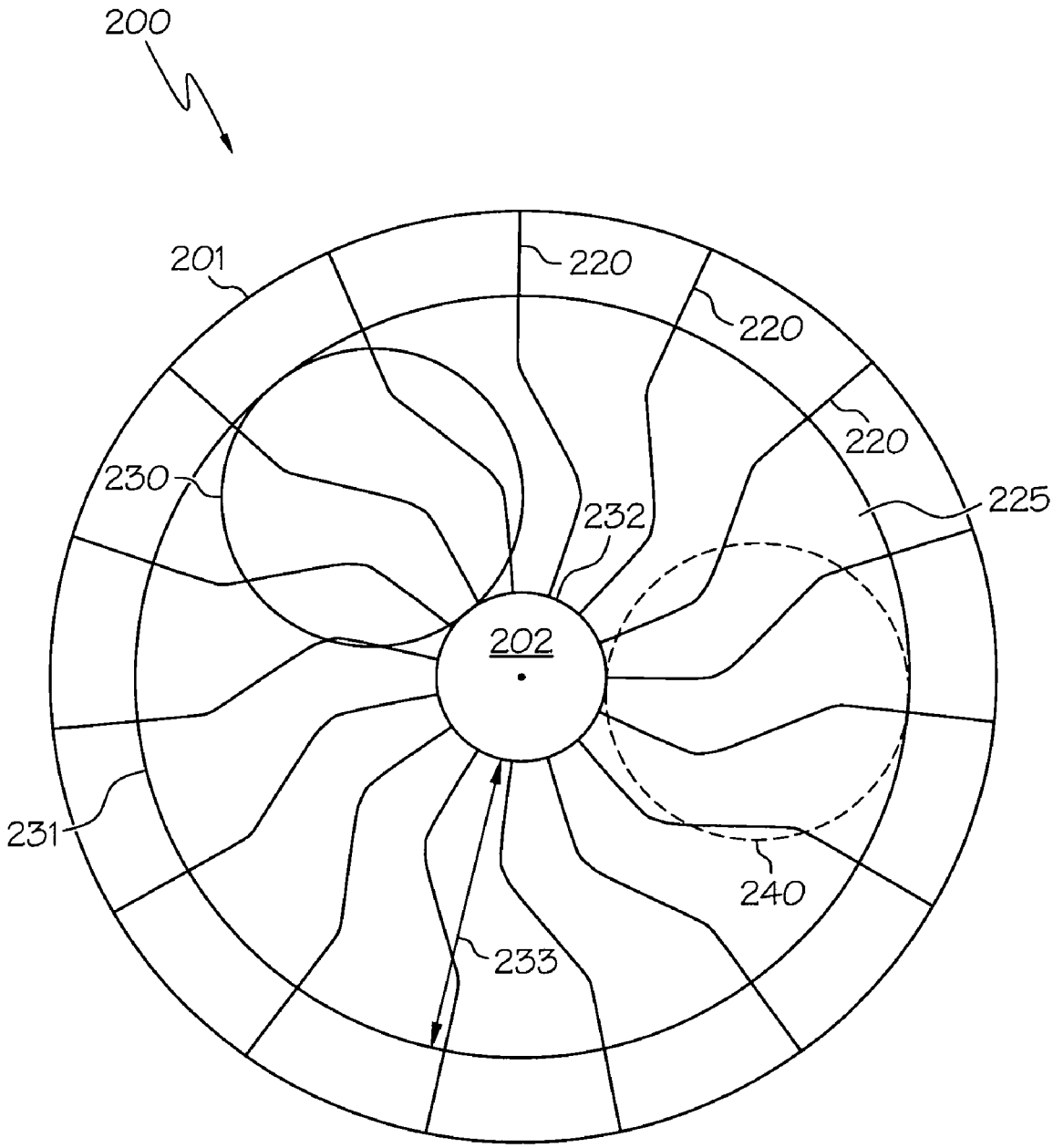
FIG. 2 is a plan view of an alternative polishing pad of the present invention having curved-radial grooves.

Referring to FIG. 2, curved-radial polishing pad 200 has a circumference 201, a rotational center 202, and a polishing track 225 for wafer 230 defined by an outer boundary 231 and an inner boundary 232 having a width 233. The polishing pad 200 has curved-radial grooves 220. Curved-radial grooves 220 are shown having a first end at the inner boundary of the polishing track 232 and having a second end at the circumference 201. Curved-radial grooves are particularly useful for controlling removal rate across the wafer and for adjusting for center-fast and center-slow polishing. Alternatively, curved radial grooves 220 (like any radial grooves of the present invention) may have a first end proximate the rotational center 202 or within the polishing track. Similarly, curved radial groove 220 (or others) may have a second end within the polishing track or proximate the outer boundary 231.

Figure 2A:
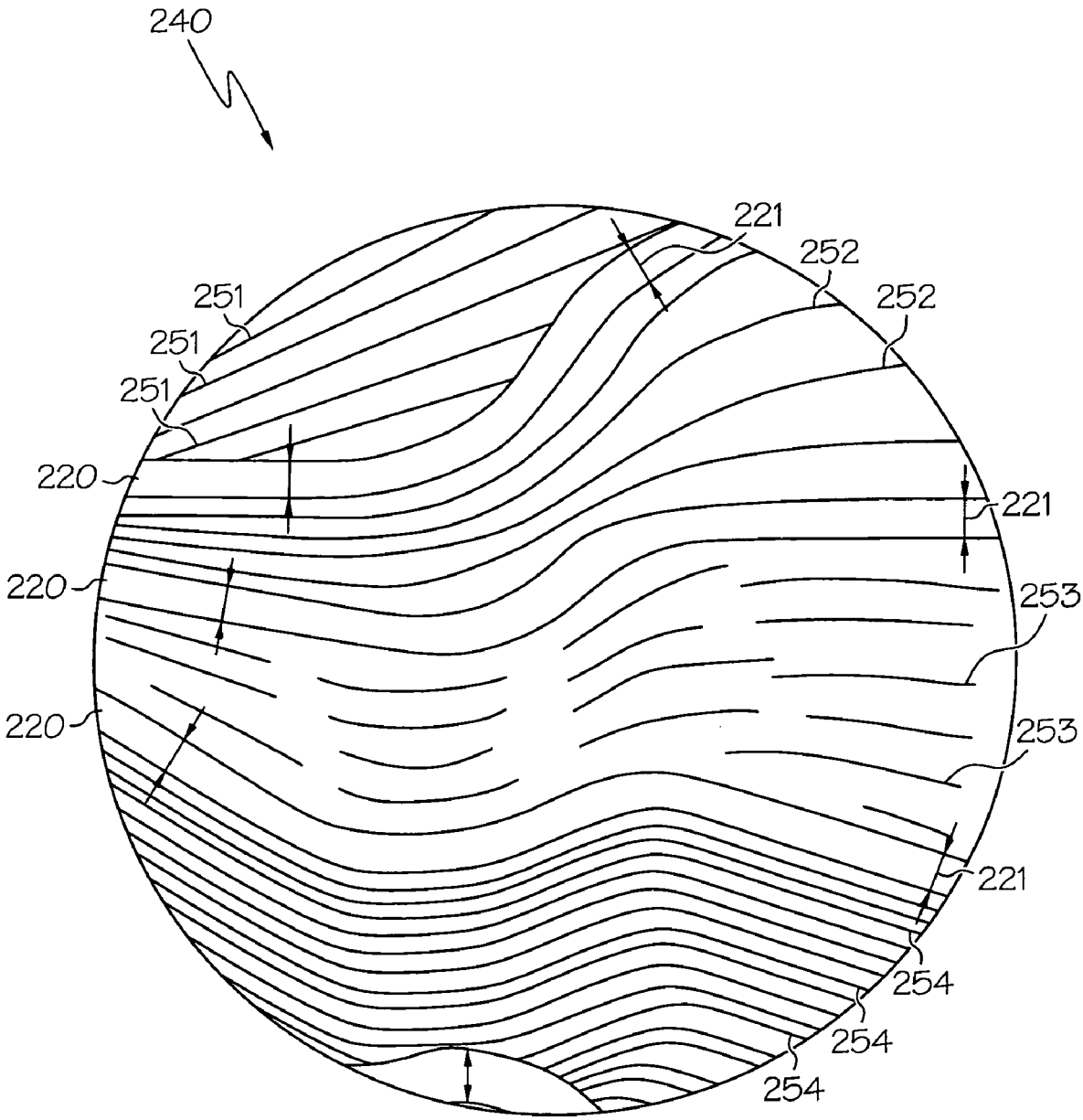
FIG. 2A is an enlarged plan view of the polishing pad of FIG. 2.

FIG. 2A illustrates micro-channels in an enlarged view of the polishing layer in the region 240 of FIG. 2. Curved-radial grooves 220 are shown to have a width 221. Radial micro-channels 251, 252, 253 and 254 are shown in their respective regions between radial grooves 220. In some embodiments containing curved-radial grooves 220, it is advantageous for the radial micro-channels, i.e. straight-radial micro-channels 251 or curved-radial micro-channels 254, to intersect with the grooves, i.e. curved-radial grooves 220. This can facilitate slurry flow and debris removal. In other embodiments, it is advantageous for the radial micro-channels to have a majority introduced in a manner that does not intersect the radial grooves, i.e. curved-radial micro-channels 252 and segmented-curved-radial micro-channels 253.

Figure 3:
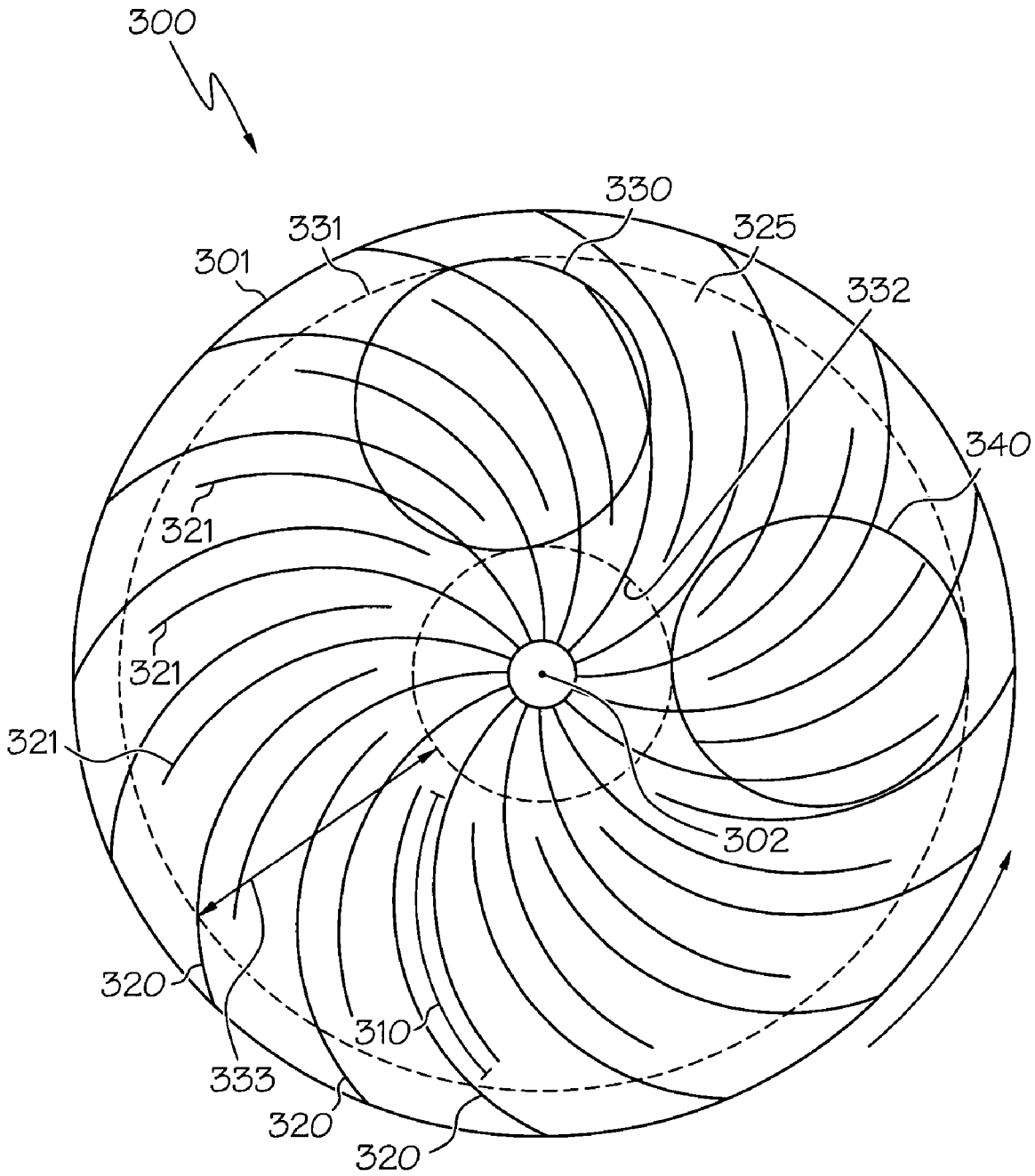
FIG. 3 is a plan view of another aiternative polishing pad of the present invention having stepped-radial grooves.

In FIG. 3, stepped-radial groove polishing pad 300 has a circumference 301, a rotational center 302, and a wafer 330 occupying a polishing track 325 having an outer boundary 331, and inner boundary 332, and a width 333. The polishing pad 300 has curved-radial grooves 320 and 321. Curved-radial grooves 321 have a first end proximate the rotational center 302 and a second end in the polishing track 325. Curved-radial grooves 320 have a first end in the polishing track 325 and a second end proximate the circumference 301. Curved-radial grooves 320 and 321 can facilitate increased polishing efficiency for the polishing medium. The Figure illustrates curved-radial grooves 320 and 321 having the same pattern and orientation, but they may have different patterns and orientations. For example, there optionally may be more than two sets of radial grooves and the radial grooves need not alternate between grooves of each set. Preferably the grooves alternate between those of a set in a regular pattern (as shown for a polishing pad with two sets of grooves). Curved-radial grooves 320 and 321 are shown having a region of overlap 310, but this is not necessary. It is preferable that the region of overlap 310 be greater than 20 percent of the width 333 of the polishing track 325 for a polishing pad having several sets of radial grooves. Most preferably, overlap 310 is greater than 50 percent of the width 333 of polishing track 325.

Figure 3A:
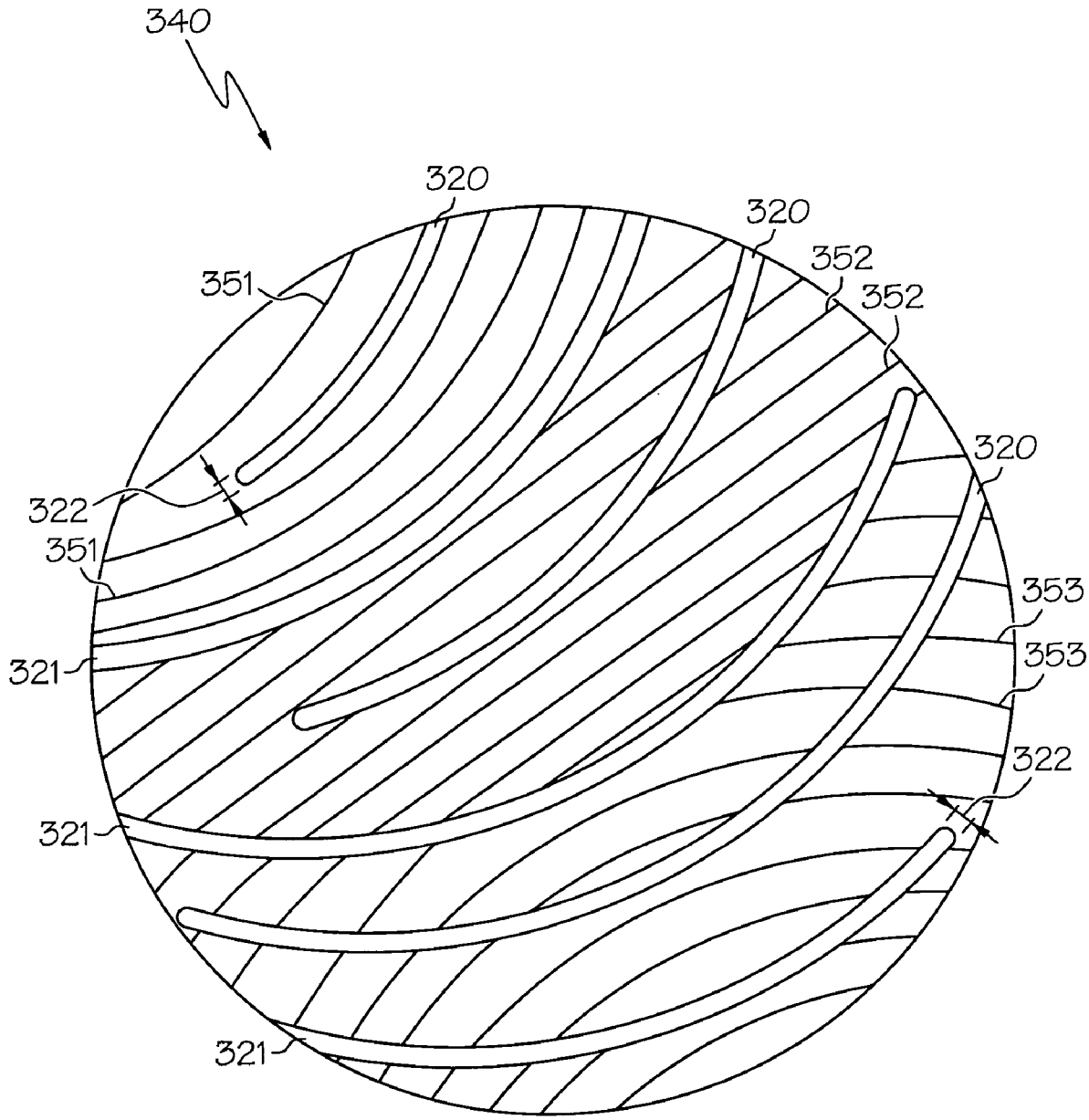
FIG. 3A is an enlarged plan view of the polishing pad of FIG. 3.

In FIG. 3A, polishing region 340 of FIG. 3 illustrates curved-radial grooves 320 and 321. These grooves have a width 322 that may be the same for grooves 320 and 321 or different for grooves 320 and 321. Curved radial micro-channels 351 are shown in a region between curved radial grooves 320 and 321. Curved radial micro-channels 351 generally follow the arcs of grooves 320 and 321 to avoid intersection. The linear-radial micro-channels 352 intersect with curved-radial grooves 320 and 321. Finally, curved-radial micro-channels 353 have a curvature biased to intersect with curved-radial grooves 320 and 321.

Figure 4:
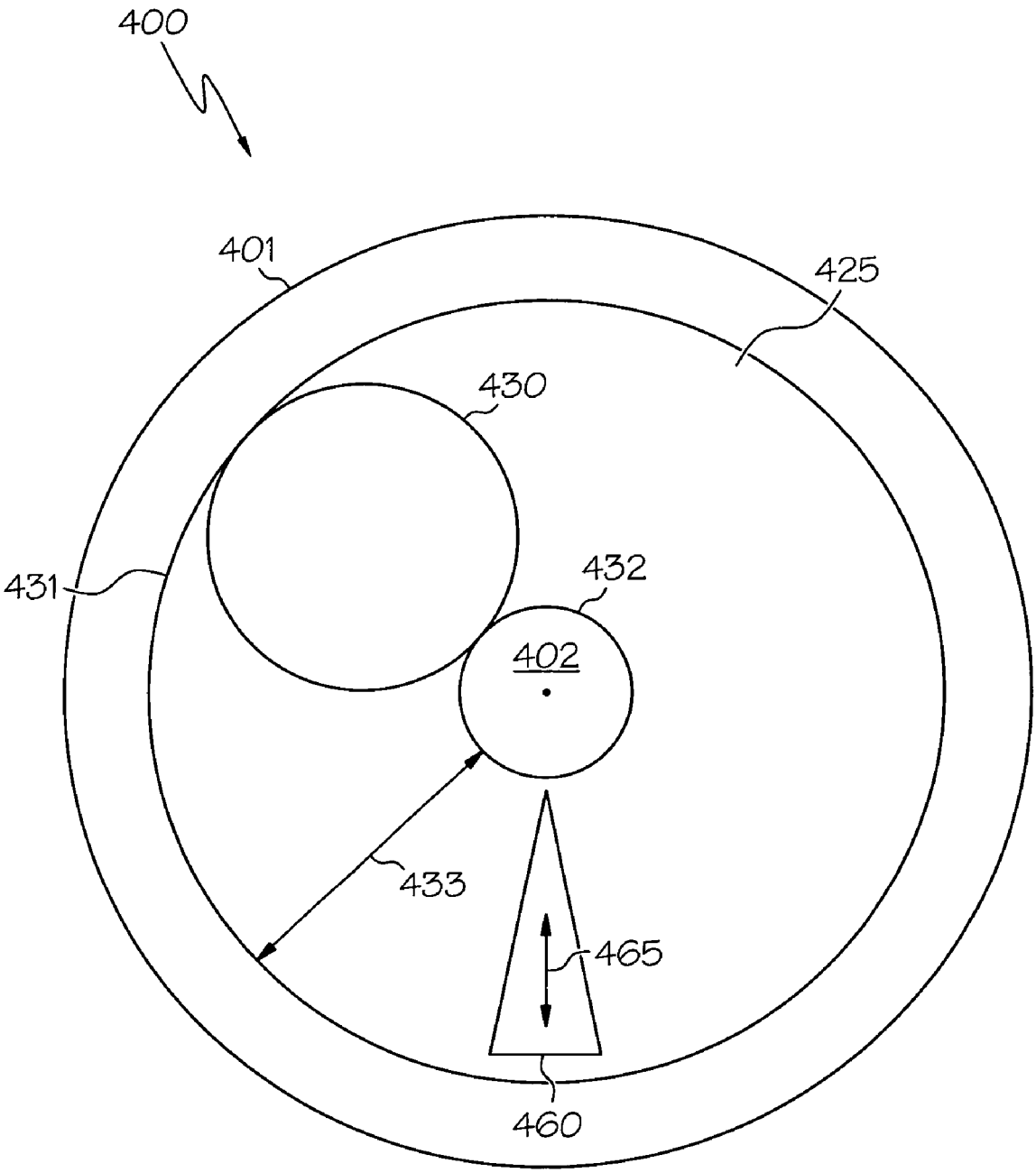
FIG. 4 is a schematic plan view of the polishing pad of FIG. 1 with a conditioning plate for carrying out the method of the present invention with a non-grooved pad.

Referring to FIG. 4, un-grooved polishing pad 400 has a circumference 401, a rotational center 402, and a wafer 430 occupying a polishing track 425 having an outer boundary 431, and inner boundary 432, and a width 433. Polishing pad 400 is free of conventional-scale grooves, Conditioning plate 460 oscillates back-and-forth through direction 465 to condition pad 400's polishing surface (not shown). The conditioning plate 460's surface preferably includes cutting means (not shown). such as diamond teeth, arranged in a pattern. The pattern may be regular or irregular and may have varying density of teeth within the conditioning surface. Preferably, the conditioning plate has a wedge shape or uses varied stroke lengths to provide more uniform conditioning throughout the polishing track 425.

In order to condition the polishing pad 400, at least part of conditioning plate 460 is contacted with the polishing layer of polishing pad 400. The conditioning plate is then moved in a direction 465 with respect to the polishing pad. The direction 465 is shown as straight and radial, although other directions are contemplated. In addition, the motion of the conditioning plate with respect to the polishing pad is shown as oscillating, but single directional motion is also contemplated. The conditioning plate may be controlled by conventional single-axis means such as a pivot arm, or a slide, or by conventional multi-axis means such as an x-y slide or an extendable pivot arm. The motion of the conditioning plate may also include vertical movements to allow intermittent contact with the polishing layer of polishing pad 400. In order to satisfy the requirements of the present invention, it is essential that the motion of conditioning plate 460 in the plane parallel to the polishing layer of polishing pad 400 is fast relative to the linear velocity of polishing pad 400.

Figure 4A:
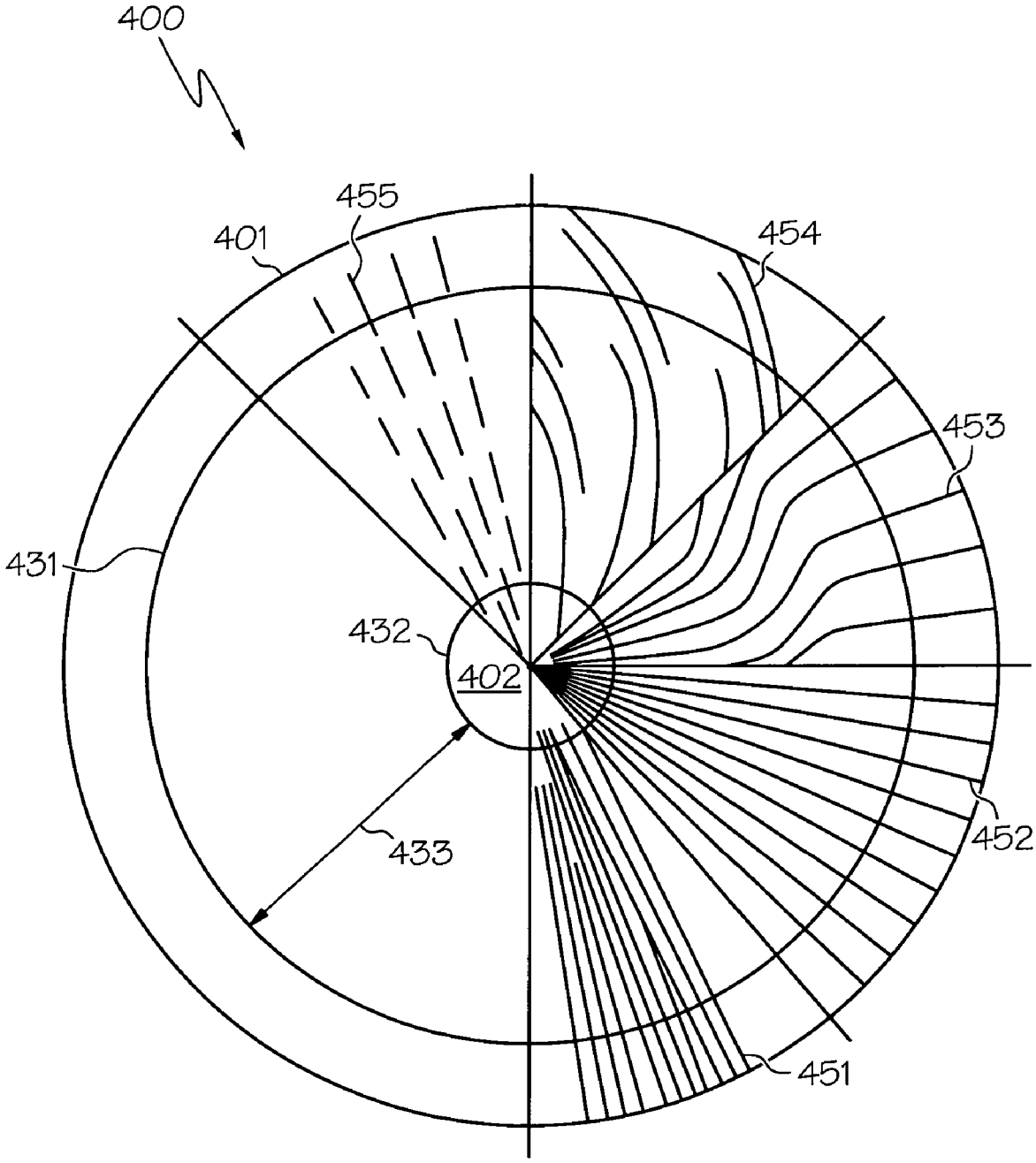
FIG. 4A is a schematic of the polishing pad of FIG. 4.

Referring to FIG. 4A, optional micro-channel patterns include parallel-radial micro-channels 451, radial micro-channels 452, curved-radial micro-channels 453, stepped or bypass radial micro-channels 454 and segmented-radial micro-channels 455. In addition, these micro-channels can have other patterns and pattern densities designed to preferentially direct the flow of the polishing medium. These micro-channels provide the advantage of controlling polishing medium flow on a small scale. For example, curved-radial micro-channels can correct wafer uniformity such as center-fast or center-slow uniformity issues and stepped-radial micro-channels can increase efficiency of the polishing medium.

Alternatively, the conditioning plate may also be a rotatable disk. The conditioning disk may be flat, curved (bowl-shaped or the edge of a flat disk may be used) or have a plurality of flat surfaces in different planes. For example, a conditioning plate may be used to create radial micro-channels by rotating the disk in a plane different than the plane in which the polishing pad lies, with at least a portion of the conditioning surface of the conditioning plate in contact with the polishing surface of the polishing pad. In addition, the longer conditioning strokes and wider conditioning plates will each lead to an increase in the proportion of parallel micro-grooves. Preferably, the conditioning process relies upon an increased number of high-speed strokes with a narrower conditioning plate to increase the proportion of radial micro-channels. These strokes are preferentially asynchronous with the pad's rotation rate to even out the micro-channel's distribution within the polishing track. In addition, arcing a conditioner plate's pivot arm in the direction of the pad's rotation can further improve the radial orientation of the micro-channels.

Another alternative is to condition the polishing pad without the use of a conditioning disk, for example by scoring the polishing surface of the polishing pad with a blade such as a knife or a milling tool such as a CNC tool. In addition, micro-channels are optionally introduced by obliterating or scoring the polishing surface of the polishing layer with a laser, high-pressure liquid or gas jet, or other means. Most preferably, continuous in situ conditioning occurs during the polishing process. In addition, in some optional embodiments, it is possible to superimpose the radial conditioning with conventional conditioning associated with rotating a circular disk, such as a circular diamond disk. Preferably, however, a majority of the micro-channels possess primarily a radial orientation in the wafer track to reduce the groove pattern transfer effect.

The invention claimed is:

1. A polishing pad useful for polishing at least one of a magnetic, optical and semiconductor substrate, comprising:

a) a polishing layer having a rotational center and including an annular polishing track concentric with the rotational center and having a width, the width of the annular polishing track containing radial grooves, the radial grooves having an average cross sectional area; and b) a plurality of radial micro-channels in the polishing layer within the width of the annular polishing track, the radial micro-channels having an average cross sectional area at a multiple of at least ten less than the average cross-sectional area of the radial grooves and a majority of the radial micro-channels having primarily a radial orientation.

2. The polishing pad according to claim 1, wherein the majority of the radial micro-channels do not intersect the radial grooves.

3. The polishing pad according to claim 1, wherein the polishing layer includes curved-radial grooves and the radial micro-channels include curved-radial micro-channels.

4. The polishing pad according to claim 1, wherein the polishing layer includes no grooves having an average cross-sectional area of at least 15,000 $\mu m^2$ within the annular polishing track.

5. A method of polishing at least one of a magnetic, optical and semiconductor substrate in the presence of a polishing medium, comprising:

polishing with a polishing pad, the polishing pad including a polishing layer having a rotational center and including an annular polishing track concentric with the rotational center and having a width, the width of the annular polishing track containing radial grooves, the radial grooves having an average cross-sectional area; and a plurality of radial micro-channels in the polishing layer within the width of the annular polishing track, the radial micro-channels having an average cross-sectional area at a multiple of at least ten less than the avenge cross-sectional area of the radial grooves and a majority of the radial micro-channels having primarily a radial orientation; and conditioning the pad during polishing to introduce additional radial micro-channels.

6. The method of claim 5 wherein the conditioning introduces the micro-channels where the majority of the radial micro-channels do not intersect the radial grooves.

7. The method of claim 5 wherein the radial grooves arc curved-radial grooves and the conditioning introduces curved-radial micro-channels.

* * * * *